US005261264A

United States Patent [19]

Jones

[11] Patent Number: 5,261,264

[45] Date of Patent: Nov. 16, 1993

[54] AUTOMATED FORMING STATION

[75] Inventor: Everett E. Jones, Wichita, Kans.

[73] Assignee: The Boeing Company, Seattle, Wash.

[21] Appl. No.: 713,318

[22] Filed: Jun. 11, 1991

[51] Int. Cl.[5] ..... B21D 22/10

[52] U.S. Cl. ..... 72/420; 72/426

[58] Field of Search ..... 72/63, 420, 426, 448; 29/784, 786, 799; 483/5, 14, 15

[56] References Cited

U.S. PATENT DOCUMENTS

| | | | |
|---|---|---|---|
| 3,111,100 | 11/1963 | Georgeff . | |
| 3,339,387 | 9/1967 | Myers | 72/63 |
| 3,727,442 | 4/1973 | Ridgeway et al. . | |
| 3,848,494 | 11/1974 | Gargrave et al. . | |
| 3,862,565 | 1/1975 | Smit . | |
| 3,875,778 | 4/1975 | Hellgren | 72/63 |
| 3,881,343 | 5/1975 | Ducate . | |
| 3,945,230 | 3/1976 | Tomioka et al. . | |
| 4,151,736 | 5/1979 | Quaas . | |
| 4,152,978 | 5/1979 | Abe et al. . | |
| 4,274,332 | 6/1981 | Nakamura . | |
| 4,408,521 | 10/1983 | Scheli et al. . | |
| 4,517,649 | 5/1985 | Kitagawa . | |
| 4,630,536 | 12/1986 | Shah . | |
| 4,700,308 | 10/1987 | Jones . | |
| 4,802,357 | 2/1989 | Jones . | |
| 4,803,772 | 2/1989 | Leverenz . | |
| 4,821,556 | 4/1989 | Bakermans et al. | 72/420 |
| 4,996,753 | 3/1991 | Jones . | |
| 4,998,206 | 3/1991 | Jones et al. . | |
| 5,031,441 | 7/1991 | Jones . | |
| 5,065,499 | 11/1991 | Luciano et al. | 29/799 |

FOREIGN PATENT DOCUMENTS

| | | | |
|---|---|---|---|
| 58-145315 | 8/1983 | Japan . | |
| 58-145316 | 8/1983 | Japan . | |
| 61-252114 | 11/1986 | Japan . | |
| 63-16820 | 1/1988 | Japan . | |
| 1-78320 | 7/1989 | Japan | 72/420 |
| 2-11231 | 1/1990 | Japan . | |

*Primary Examiner*—Lowell A. Larson

*Attorney, Agent, or Firm*—Finnegan, Henderson, Farabow, Garrett & Dunner

[57] ABSTRACT

An apparatus under control of a computer for forming into a three-dimensional shape a generally planar workpiece having a pair of spaced holes therein at predetermined positions, the apparatus comprising a forming tool including a molding surface having a pair of spaced bores therein at predetermined positions and a locating pin disposed in each bore for selective axial movement therein; guide tracks and selectively operable drive mechanisms for moving the tool through an operating circuit including sequential mating, molding and removal stations; a selectively operable transferring mechanism at the mating station for disposing the workpiece on the molding surface of the tool with respective hole and bore positions in registration; a ram at the mating station for selectively projecting one end of each locating pin into a respective hole to restrain the workpiece on the molding surface; a hydropress at the molding station for forming the workpiece to the shape of the molding surface; and selectively operable gripping mechanism at the removal station for removing the shaped workpiece from the tool.

9 Claims, 14 Drawing Sheets

AUTOMATED FORMING STATION

BACKGROUND OF THE INVENTION

1. Field of the Invention

The invention is directed to an automated forming apparatus and, more particularly, to a station of a computerized manufacturing facility for forming generally planar workpieces into three dimensional shapes.

2. Description of Related Information

The apparatus of the invention is a molding station for a computer-controlled automated manufacturing system wherein sheet metal is transformed into computer-defined finished parts without manual intervention. Although not directed to the molding station, aspects of the manufacturing system are described in U.S. Pat. Nos. 4,700,308, 4,802,357, 4,996,753, 4,998,206, and pending U.S. patent application Ser. Nos. 07/469,022 (filed Jan. 23, 1990); 07/358,429 (filed May 30, 1989) and 07/543,406 (filed Jun. 26, 1990).

Molding and ram press apparatus having certain automated features are known. Exemplary of such known devices are U.S. Pat. Nos. 3,111,100, 3,727,442, 3,848,494, 3,862,565, 3,881,343, 3,945,230, 4,151,736, 4,152,978, 4,274,332, 4,408,521, 4,517,649, 4,630,536, and 4,803,772, and Japanese Patent Nos. 58-145315, 58-145316, 61-252114, 63-16820 and 2-11231. While each of these references discloses an apparatus for molding or pressing wherein some aspect is automated, none of the references suggests the particular combination of features in the subject invention.

The advantages of the invention are set forth in part in the description which follows, and in part will be obvious from the description, or may be learned by practice of the invention.

SUMMARY OF THE INVENTION

The advantages of the invention may be realized and attained by means of the instrumentalities and combination particularly pointed out in the appended claims.

The invention, as embodied and broadly described herein, is an apparatus under control of a computer for forming into a three-dimensional shape a generally planar workpiece having a pair of spaced holes therein at predetermined positions, the apparatus comprising a forming tool including a molding surface having a pair of spaced bores therein at predetermined positions and a locating pin disposed in each bore for selective axial movement therein, means for selectively moving the tool through an operating circuit including sequential mating, molding and removal stations, means at the mating station for disposing the workpiece on the molding surface of the tool with respective hole and bore positions in registration, means at the mating station for selectively projecting one end of each locating pin into a respective hole to restrain the workpiece on the molding surface, means at the molding station for forming the workpiece to the shape of the molding surface, and means at the removal station for removing the shaped workpiece from the tool.

The invention further comprises a method of forming a generally planar workpiece to the shape of a molding surface on a forming tool, the method comprising the steps of drilling a pair of spaced holes in the workpiece at predetermined positions, disposing the workpiece on the molding surface at a predetermined position with the holes in registration with a pair of spaced bores in the molding surface, projecting one end of a locating pin disposed in each bore in the molding surface into a respective hole of the workpiece to restrain the workpiece in position on the molding surface, and molding the workpiece to the shape of the molding surface with one end of each locating pin in a respective hole.

Preferably, the method of the invention further includes after the molding step, the steps of retracting the locating pins from the holes in the workpiece, engaging the workpiece through the holes therein, and removing the workpiece from the molding surface.

BRIEF DESCRIPTION OF THE DRAWINGS

The accompanying drawings which are incorporated in and constitute a part of this specification, illustrate embodiments of the invention and, together with the description, serve to explain the principles of the invention.

DESCRIPTION OF THE PREFERRED EMBODIMENT

Reference will now be made in detail to the present preferred embodiments, examples of which are illustrated in the accompanying drawings.

The automated forming apparatus of the invention is particularly intended for use in conjunction with a computer controlled manufacturing system. The concept of workpiece orientation in such a system and at each station at which operations are performed is disclosed in U.S. Pat. No. 4,700,308 to the same inventor. The computer controlled system and software for operating it is disclosed in U.S. Pat. No. 4,998,206. These two patents are hereby specifically incorporated by reference. While the subject invention is not specifically addressed in the patents, the principles of computer-controlled operation and workpiece orientation and control apply and are not repeated herein.

Figure 1:
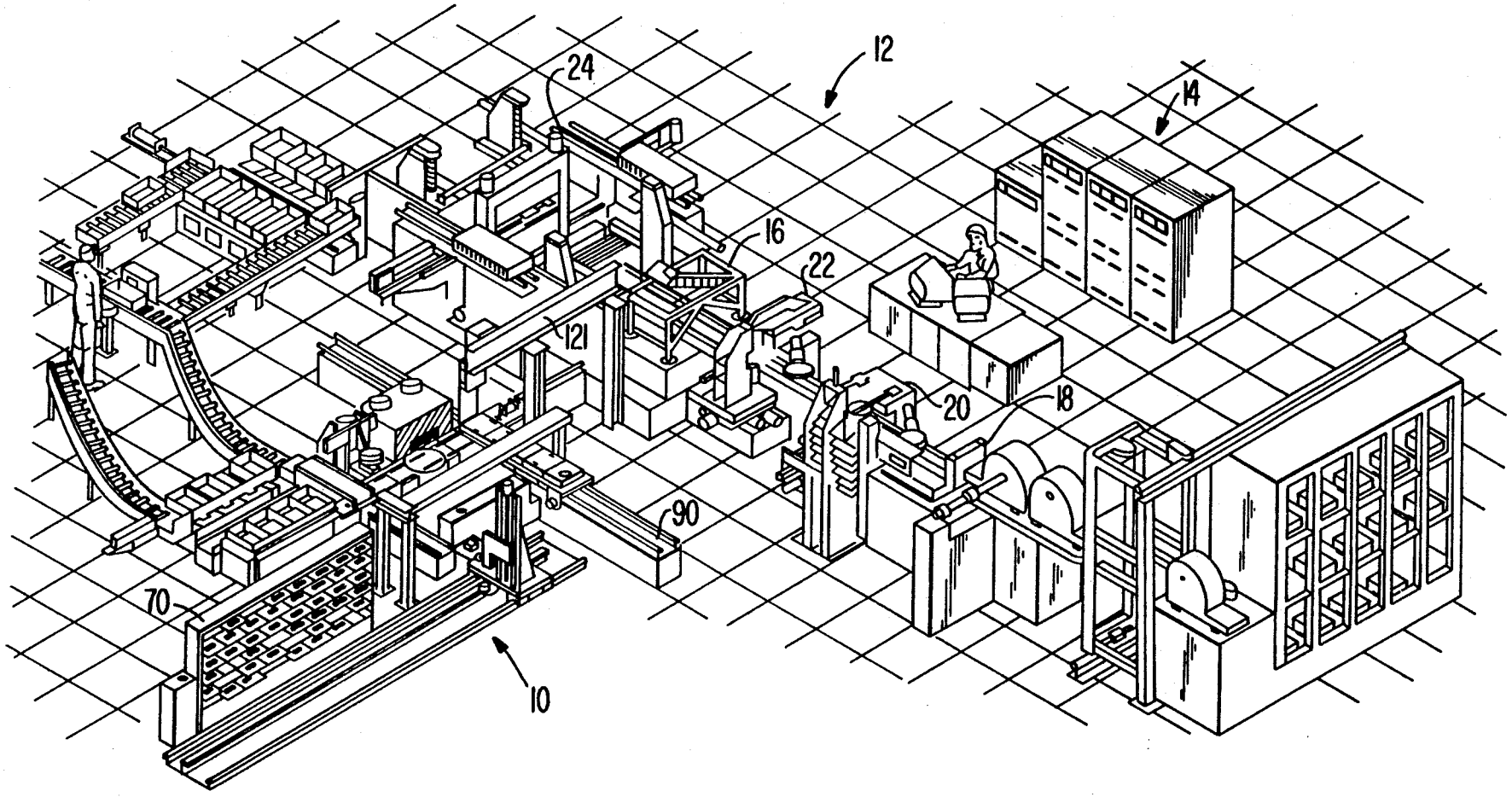
FIG. 1 is a perspective view of a computer controlled manufacturing system incorporating the automated forming station of the invention.

As depicted in FIG. 1, the automated forming apparatus 10 is preferably incorporated as one station in a series of functional stations in a computer controlled manufacturing system 12. As described in U.S. Pat. Nos. 4,700,308 and 4,998,206, workpieces are carried between the individual stations in the manufacturing system 12 by means of automated apparatus, the position and function of which is controlled by computer 14. The subject invention is particularly intended for use as a functional station in the computer controlled manufacturing system, but it may be used as a computer controlled forming apparatus independent of an overall manufacturing system with workpieces being introduced into the forming apparatus of the invention either manually or by mechanical means.

In the embodiment of the computer controlled manufacturing system 12 depicted in FIG. 1, workpieces at the vision quality assurance station 16 have been cut at shear station 18, drilled at drill station 20 and profiled and deburred at profile station 22. These preceding operations are confirmed at vision station 16 and then under computer control the workpiece is either conveyed to brake forming station 24 or made available for introduction into the forming apparatus of the invention. The apparatus 10 of the invention is under the control of computer 14 for forming into three-dimensional shape a generally planar workpiece having a hole therein at a predetermined position. Under computer control, the spaced holes are placed in the workpiece at drilling station 20. As described in U.S. Pat. Nos. 4,700,308 and 4,998,206, each operation in the manufacturing system is conducted with reference to computer defined orthogonal reference X and Y axes on each workpiece and at each station. The computer, therefore, determines predetermined positions of the holes drilled in the workpiece at drilling station 20 and determines the position of the workpiece at each station in relation to the operative elements thereof.

Figure 3:
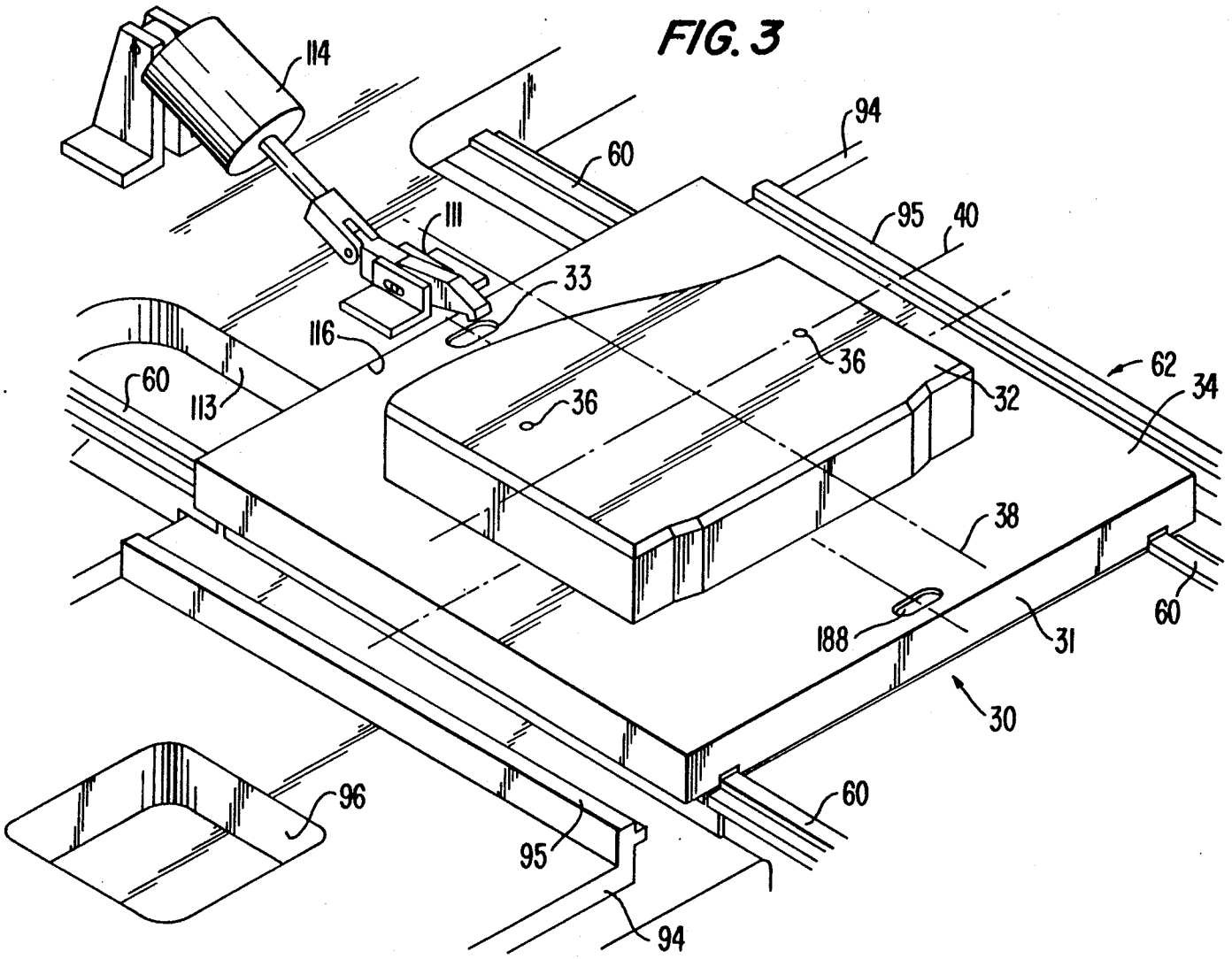
FIG. 3 is an enlarged perspective view of a forming tool in position at the mating station of the forming apparatus of the invention.
Figure 4:
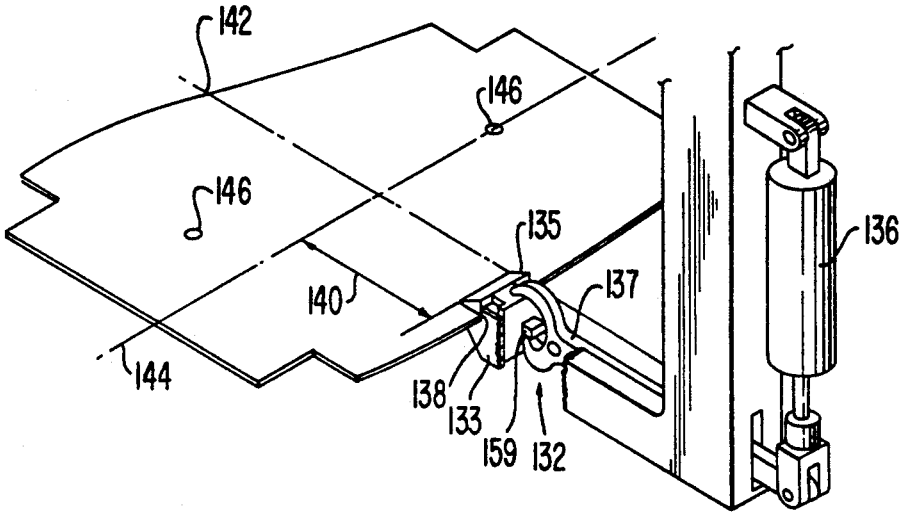
FIG. 4 is a partial perspective view of the gripper mechanism of the invention holding a workpiece
Figure 8:
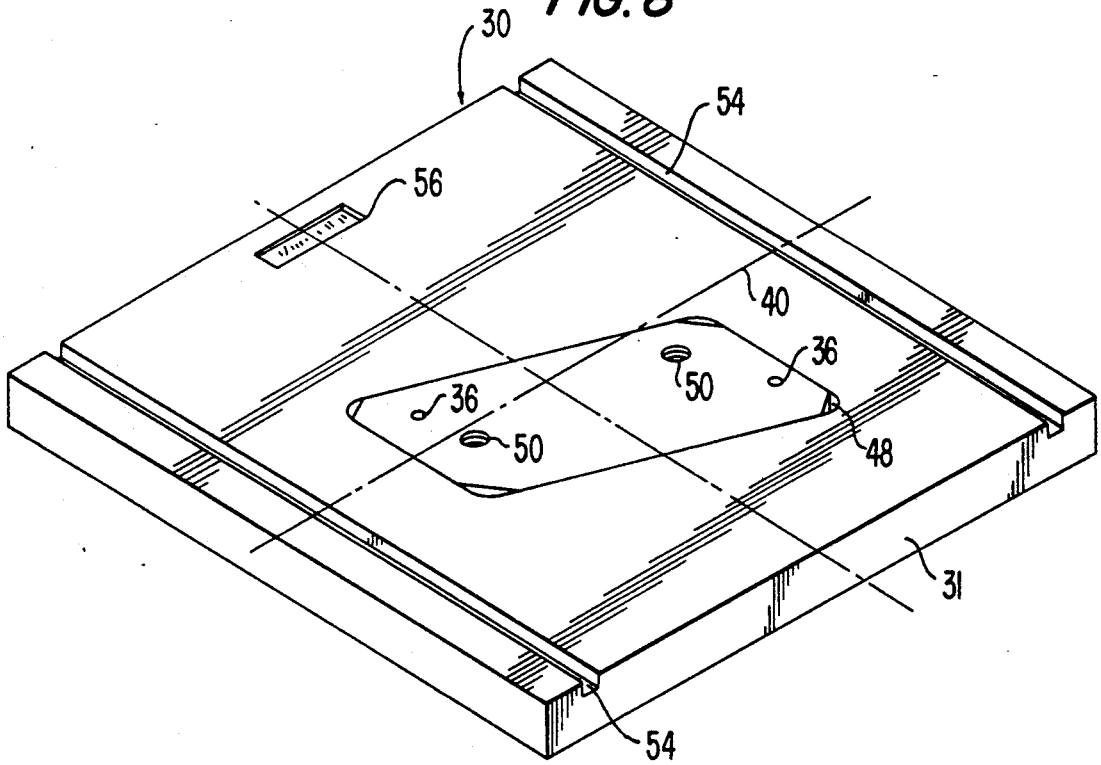
FIG. 8 is a bottom perspective view of a forming tool.
Figure 5:
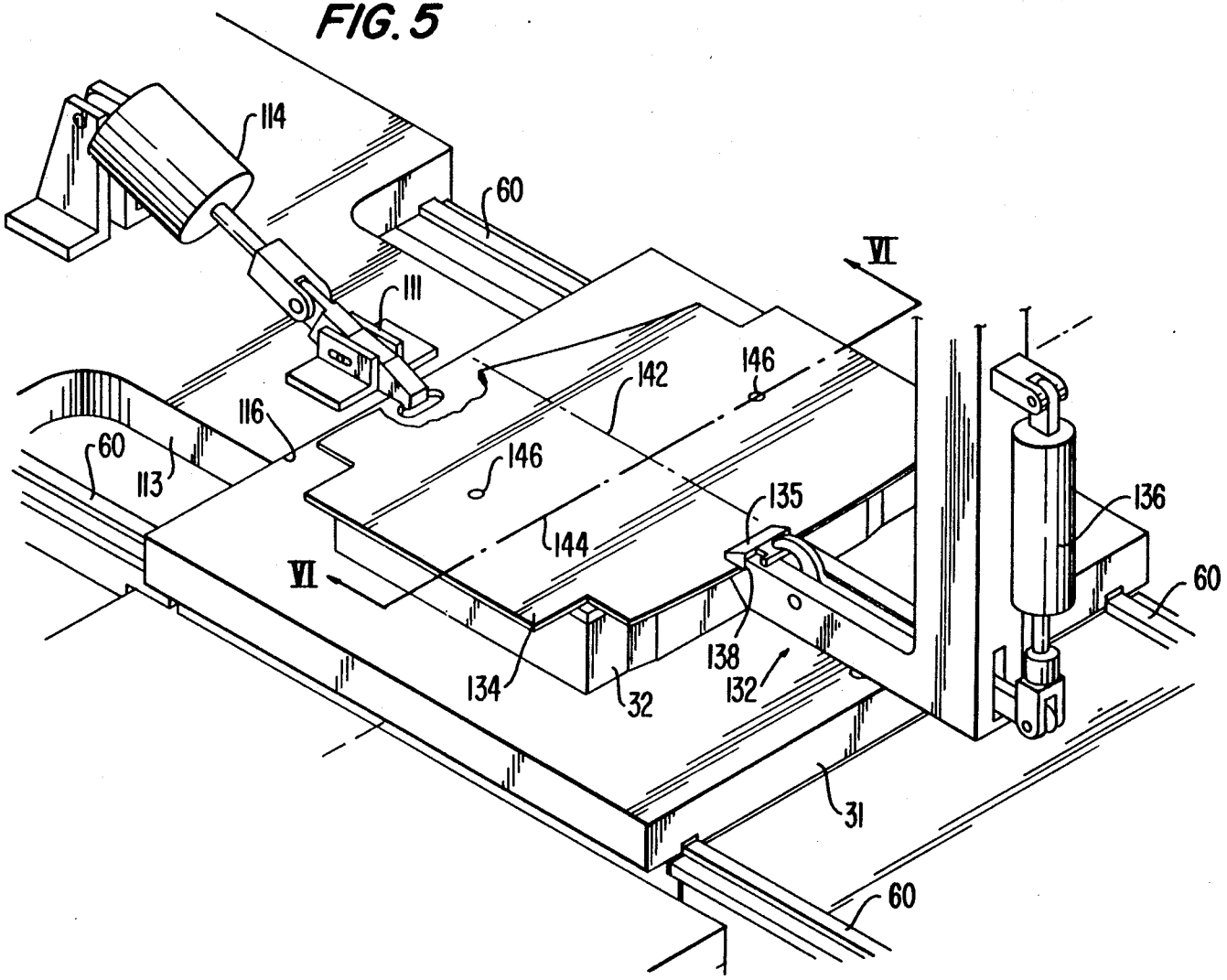
FIG. 5 is a partially cut-away perspective view of the forming tool at the mating station with a workpiece disposed thereon by the gripper mechanism.
Figure 6:
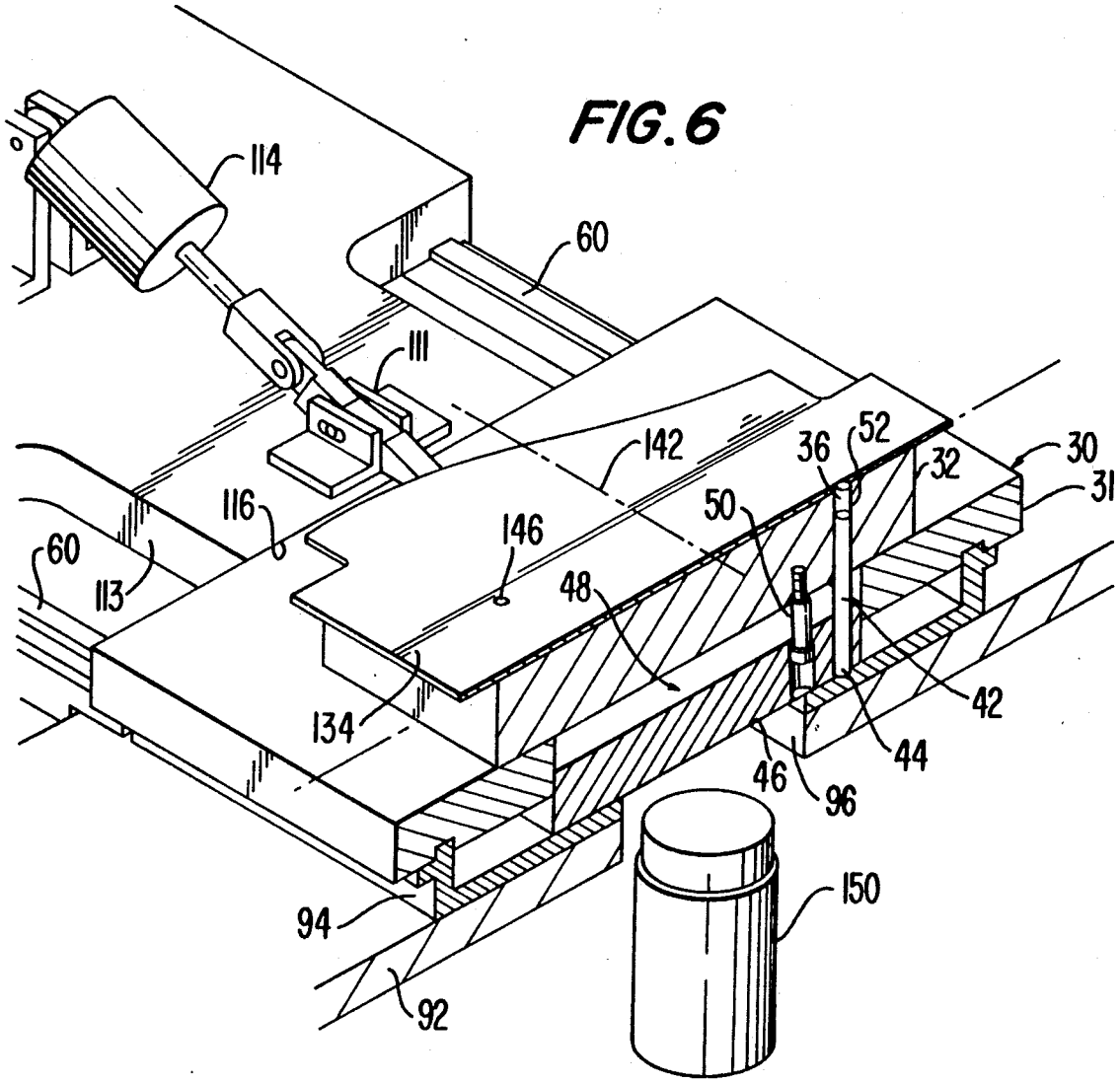
FIG. 6 is a cross-sectional view of the forming tool and mating station taken along lines VI—VI of FIG. 5.

In accordance with the invention, the apparatus comprises a forming tool including a molding surface having a pair of spaced bores therein at predetermined positions and a locating pin disposed in each bore for selective axial movement therein In the preferred embodiment depicted in FIGS. 3, 6 and 8, forming tool 30 includes a base 31 supporting molding surface 32 on one side 34 thereof. The forming tool includes a pair of bores 36 extending through the base 31 and molding surface 32. The bores 36, as depicted in FIG. 3, are spaced in predetermined relation to orthogonal reference X and Y axes 38, 40 computer defined on tool 30.

As depicted in FIG. 6, locating pin 42 is disposed in each bore 36 (one shown) for selective axial movement therein. One end 44 of each locating pin 42 is fixed to cross bar 46 movably disposed in recess 48 in base 31 of forming tool 30. Cross bar 46 is disposed for movement relative to base 31 between a raised position and a lowered position defined by the head of support bolts 50. Movement of cross bar 46 to the raised position projects the other end 52 of each locating pin 42 out of bore 36 a predetermined distance above the surface of molding surface 32.

As depicted in FIG. 8, each forming tool also includes in base 31 on the other surface thereof a pair of spaced parallel channels 54 and an identifying tag 56 which is preferably optically readable, such as a bar code.

Figure 15:
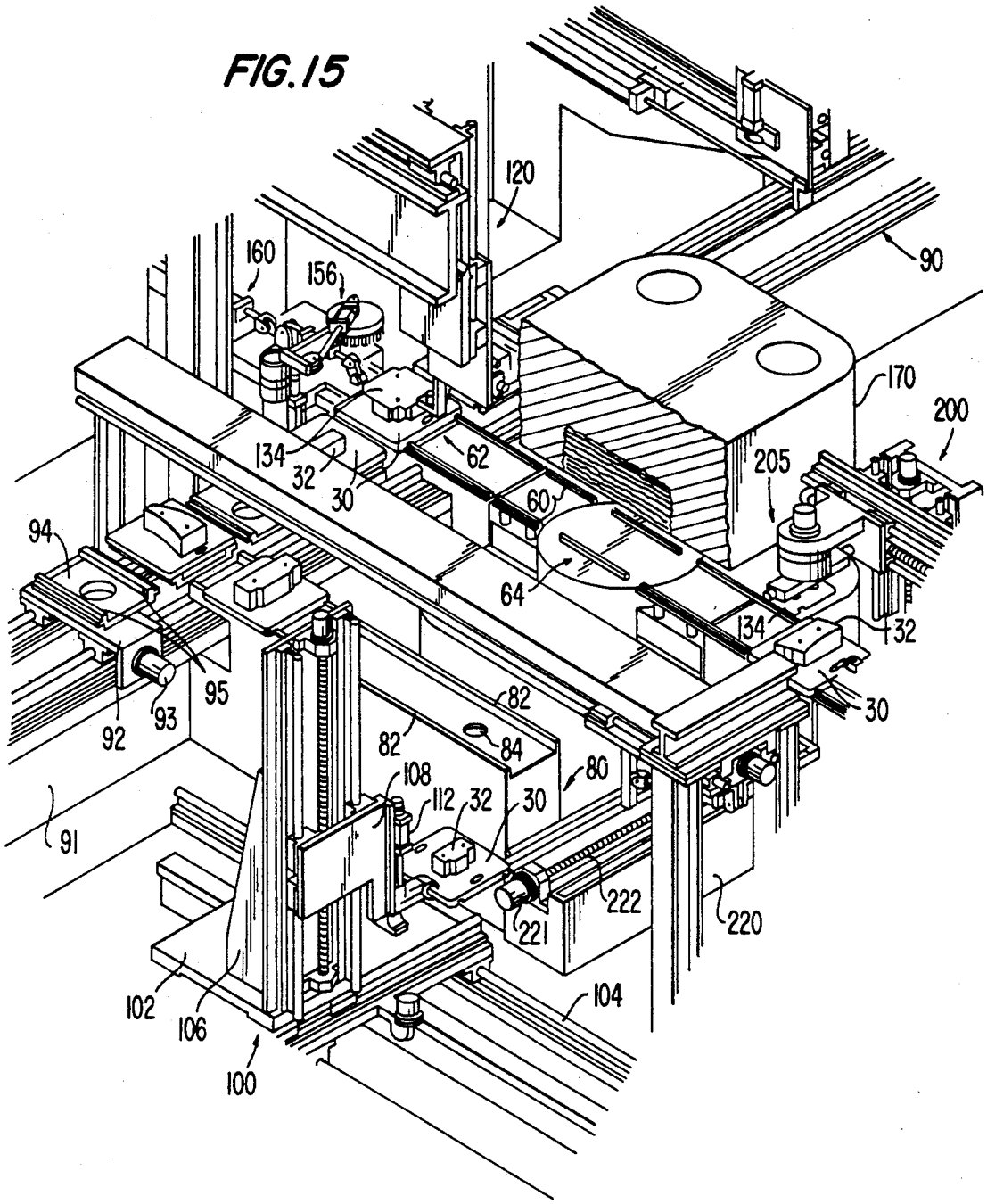
FIG. 15 is a perspective view of the mating, molding, removal, receiving and feeding stations of the invention.

In accordance with the invention, the apparatus further comprises means for selectively moving the tool through an operating circuit including sequential mating, molding and removal stations. In a preferred embodiment as depicted in FIG. 15, the moving means comprises parallel guide tracks 60 disposed for cooperation with parallel channels 54 in the other side of the tool base 31. Guide tracks 60 slidably support tool base 31 in a predetermined orientation during movement through the circuit including mating station 62, molding station 64 and removal station 66 and for maintaining predetermined orientation during operations at each of the stations.

Figure 14:
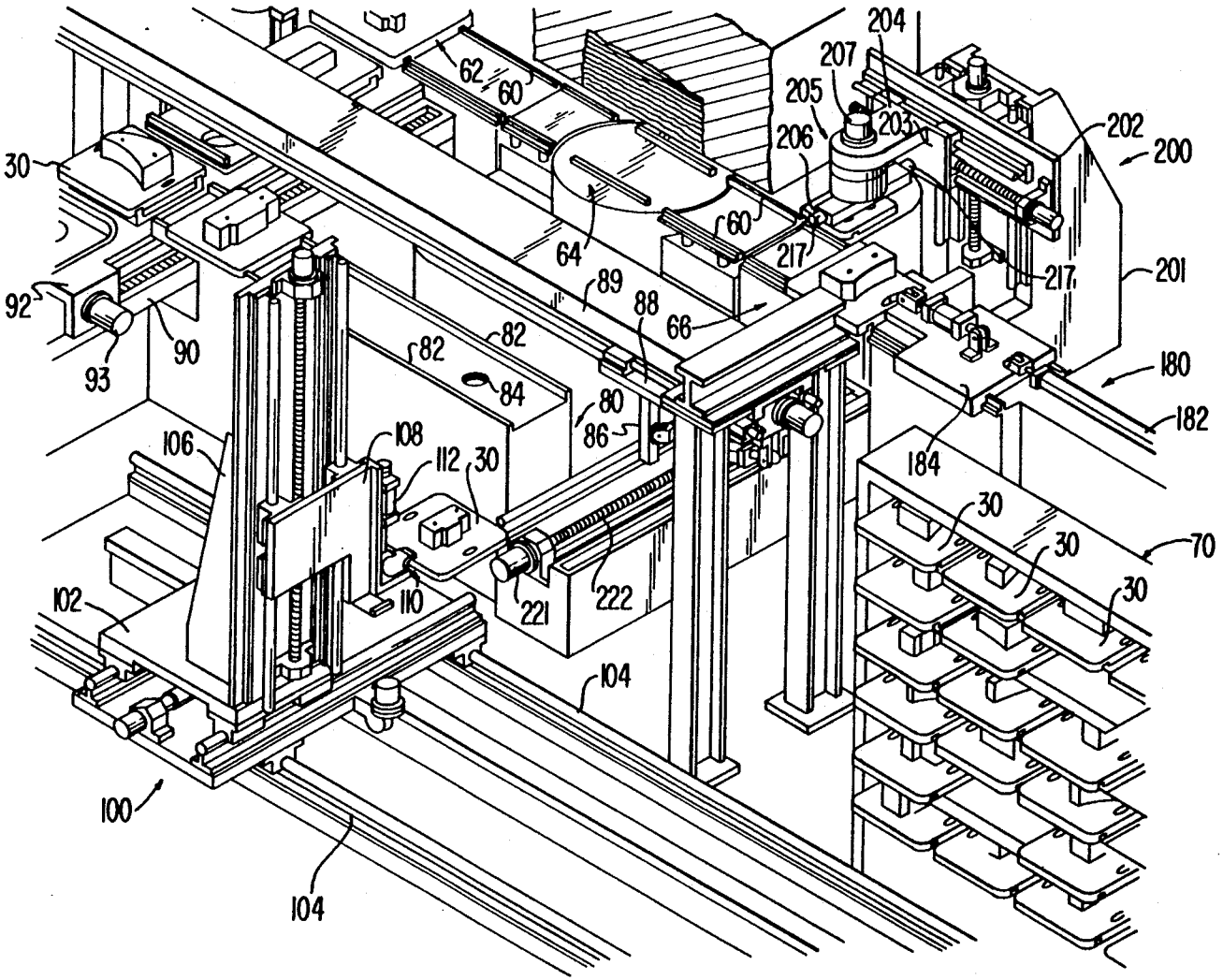
FIG. 14 is a perspective view of the molding removal storage and receiving stations of the invention.

In the preferred embodiment as depicted in FIG. 14, the apparatus further includes a plurality of tools 30 each including a molding surface 32 supported on one side of base 31, a storage station 70 containing the plurality of tools 30 in known locations, a receiving station 80 for assembling tools 30 in a predetermined order, a feeding station 90 for conveying selected tools 30 to the mating station 62, means for transporting selected tools between storage station 70 and receiving station 80, means for transferring a tool from removal station 66 to receiving station 80, means at receiving station 80 for identifying each tool disposed thereon, and means for delivering selected tools from receiving station 80 to feeding station 90.

Figure 2:
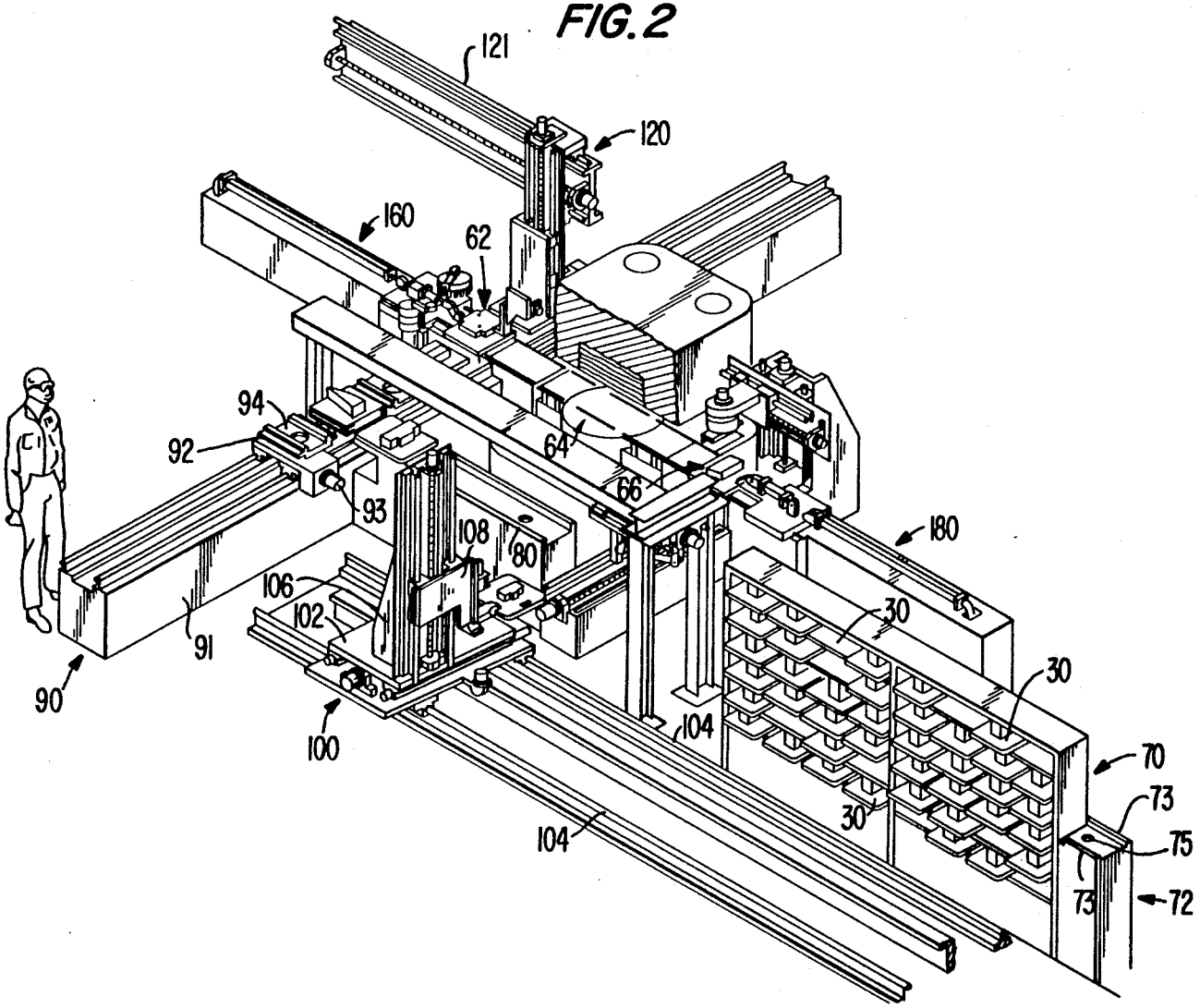
FIG. 2 is a perspective view of the automated forming station of the invention.

As depicted in FIGS. 2 and 14, storage station 70 includes a plurality of positions for receiving tools 30. Each position is known to the computer. Each tool 30 is manually disposed on optical reader station 72 permitting the computer to identify the tool by means of bar code 56 on the other side of base 31. Optical reader station 72 includes tracks 73 disposed to cooperate with channels 54 in the other surface of base 31 of each tool 30. Because of the location of reader element 75 at station 72 and bar code 56 on each tool 30, tools can only be disposed on station 72 in one orientation. That orientation is maintained throughout operation of the apparatus.

The transporting means of the preferred embodiment, as depicted in FIG. 2, 14 and 15, includes a computer controlled lift mechanism 100 comprising base 102 disposed on tracks 104 for selective movement between storage station 70 and receiving station 80, vertical element 106 disposed on base 102 for selective movement transverse tracks 104, and lift element 108 disposed on vertical element 106 for selective vertical movement. Lift element 108 includes support clamp 110 and cylinder 112 for selectively opening and closing clamp 110 to grasp and release individual tools 30. Tracks 104 of transport mechanism 100 are disposed adjacent receiving station 80, storage station 70 and optical reader station 72 to permit clamp 110 to selectively receive and deposit tools 30 on one end of receiving station 80, in individual locations in storage station 70 and on optical reader station 72. New tools 30 manually disposed on optical reader station 72, after being identified by the computer through optical reading of bar code 56, are retrieved by transporter mechanism 100 and disposed in predetermined positions in storage station 70. The computer, thus, has in memory the location of each unique tool 30 in storage station 70. During operation, the computer determines which tools are required and directs transporter 100 to retrieve the appropriate tools in the appropriate sequence from storage station 70 and sequentially to carry the tools to receiving station 80.

As depicted in FIG. 14, receiving station 80 includes parallel tracks 82 disposed to slidably support tools 30 in channels 54 for slidable movement thereon. Receiving station 80 also includes optical reader element 84 at one end thereof. Tools 30 disposed on receiving station 80 are initially placed at the one end thereof with bar code element 56 over character reader 84 permitting the computer to verify the identity of each tool placed on receiving station 80. The means for delivering selected tools from the receiving station to the feeding station comprises retractable push lever 86 pivotally carried by carriage 88 for selected movement along track 89. Push lever 86 is disposed for selective movement between a lowered position as depicted in FIG. 14 and a raised position. In the lowered position, selected movement of carriage 88 permits engagement of tools 30 on tracks 82 of receiving station 80 and selective movement of such tools to the other end of receiving station 80.

Figure 13:
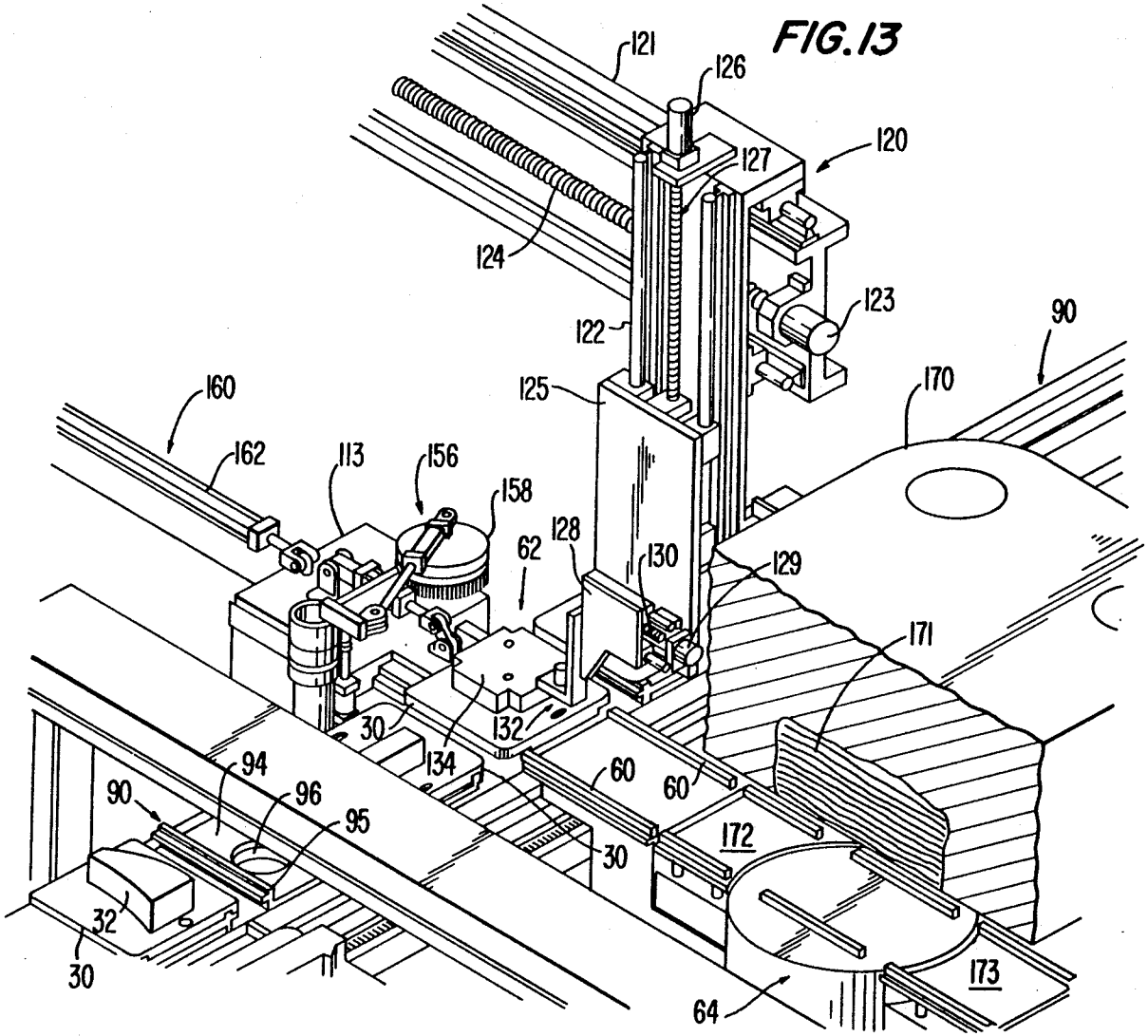
FIG. 13 is an enlarged perspective view of the mating and molding stations of the invention.

Feeding station 90 of the preferred embodiment, as depicted in FIGS. 2, 13 and 15, includes an elongated track 91 intersecting guide tracks 60 at mating station 62. Elongated platform 92 is disposed on track 91 for selective movement thereon between mating station 62 and the other end of receiving station 80. Computer-controlled motor 93 selectively drives platform 92 along track 91. A plurality of saddles 94 are fixed to platform 92 in adjacent relationship. Each saddle 94 includes parallel tracks 95 disposed to align with tracks 82 of receiving station 80 and guide tracks 60 at mating station 62 when the saddle is moved on track 91 to the respective station. A saddle 94 located at the other end of receiving station 80 is disposed to slidably receive a tool 30 moved by push lever 86. Tracks 95 of a saddle 94 located at mating station 62 form a part of guide tracks 60 to permit movement of a tool 30 on the saddle as necessary at the mating station and from mating station 62 to molding station 64. Each saddle 94 has a central bore 96 in alignment with a corresponding bore in platform 92 and located to be in alignment with cross bar 46 of a tool 30 disposed on the saddle.

In accordance with the invention, the apparatus further comprises means at the mating station for disposing the workpiece on the molding surface of the tool with the respective hole and bore positions in registration. Preferably, the disposing means comprises means for selectively fixing the tool in a predetermined position at the mating station and means for retrieving a predetermined workpiece from a remote location and for placing the predetermined workpiece on the molding surface with respective holes and bores in axial registration.

In the preferred embodiment, as depicted in FIG. 3, the apparatus includes a selectively operable first clamp 111 disposed to engage slot 33 in one side of base 31 of a tool 30 carried by a saddle 94 to mating station 62. First clamp 111 is fixed to first platform 113 which also supports cylinder 114 for operating first clamp 111 under computer control. First platform 113 defines a stop surface 116 against which the one side of base 31 abuts by the action of first clamp Ill pulling tool 30 along tracks 95 of the saddle and guide tracks 60. First clamp 111 and stop surface 116 serve to selectively fix tool 30 in a predetermined position at mating station 62.

As depicted in FIGS. 2 and 13, the apparatus includes workpiece retriever 120 including elongated support track 121 extending between mating station 62 and a remote location source of workpieces such as vision station 16. Retriever 120 includes first support 122 disposed on support track 121 for selective movement thereon by means of computer-controlled motor 123 and screw 124. Second support 125 is carried by first support 122 for selective movement transverse the axis of support track 121, movement of second support 125 is effected by computer-controlled motor 126 and screw 127 carried by first support 122. Third support 128 is carried by second support 125 for selective movement transverse the axis of second support 125, movement being effected by computer-controlled motor 129 and screw 130 carried by second support 125.

As best seen in FIGS. 4, 5, 7 and 13, retriever 120 includes gripper mechanism 132 carried by third support 128. Gripper mechanism 132 includes a support element 133 extending in fixed relation from third support 128 in a position to engage and support the lower surface of a workpiece 134 and clamp element 135 connected in opposed relation to support element 133 for selective movement between open and closed positions. Computer-controlled piston/cylinder 136 carried by third support 128 is connected to clamp element 135 through pivotally-mounted rod 137 to selectively move clamp element 135 between open and closed positions.

Support element 133 of retriever 120 includes a shoulder 138 disposed to abut an edge of workpiece 134 thereby permitting the computer to determine the distance 140 between gripper mechanism 132 and orthogonal reference Y axis 144 defined on workpiece 134 when the workpiece is engaged at the remote location. Since retriever 120 moves gripper mechanism 132 in a predetermined plane parallel to track 121, the computer determines the relative position of gripper mechanism 132 when at the remote location to orthogonal X axis 142 defined on workpiece 134. Workpiece 134 includes holes 146 in predetermined positions relative to orthogonal X and Y axes 142, 144. Workpiece 134, therefore, is in a known position relative to gripper mechanism 132 during transport by retriever 120 from the remote location to mating station 62. The computer, when disposing workpiece 134 on molding surface 32 of tool 30 at mating station 62, determines the position of workpiece 134 relative to orthogonal X and Y axes 38, 40 of tool 30 held in fixed position by first clamp 111. Since bores 36 in tool 30 are in predetermined positions relative to X and Y axes 38, 40, the computer determines the control of retriever 120 to place workpiece 134 on molding surface 32 with holes 146 in axial registration with bores 36.

Figure 7:
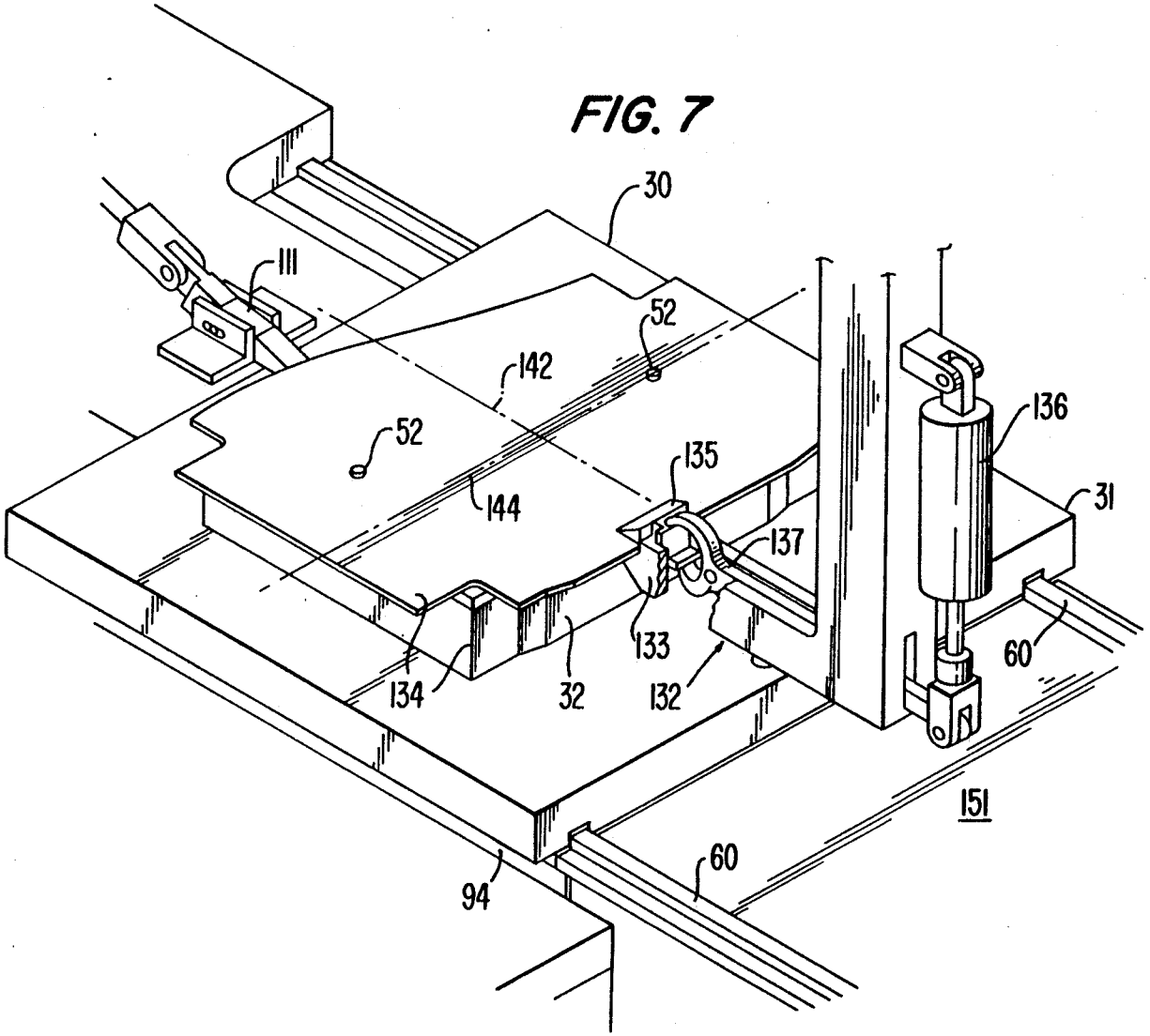
FIG. 7 is a perspective view of the forming tool at the mating station with a workpiece restrained thereon by the locating pins.

In accordance with the invention, the apparatus further comprises means at the mating station for selectively projecting one end of each locating pin into a respective hole to restrain the workpiece on the molding surface. In the embodiment depicted in FIG. 6, the apparatus includes piston 150 disposed for axial alignment with bore 96 in saddle 94 placed at mating station 62. Piston 150, after workpiece 134 is disposed on tool 30 at mating station 62, is operated under computer control to engage cross bar 46 and move it and attached locating pins 42 to the raised position wherein one end 52 of each pin 42 projects through the respective bore 36 into the respective hole 146 in workpiece 134 as depicted in FIG. 7. Because saddle 94 is spaced from the other surface of tool base 31, cross bar 46 is normally in the lowered position under the influence of gravity while tool 30 is on the saddle. Once moved to the raised position, cross bar 46 becomes generally co-planar with base 31. The surface 151 between guide tracks 60 supports cross bar 46 in the raised position during movement of tool from mating station 62 to molding station 64 and removal station 66.

To insure that workpiece 134 remains in position on molding surface 32 during movement of locating pins 42 into holes 146 while allowing slight movement of workpiece 134 in its plane for slight adjustment of alignment of holes 146 with pins 42, the apparatus preferably includes a selectively moveable brush structure 156 as depicted in FIG. 13. Brush structure 156 is supported independently of mating station 62 and of first platform 113 for computer-controlled movement between retracted and engaging positions, the latter disposing the bristles of brush 158 into contact with workpiece 134 on molding surface 32 at mating station 62. Brush 158 opposes movement of workpiece 134 away from molding surface 32 while permitting one ends 52 of locating pins 42 to project through holes 146. Since exact registration of holes 146 with bores 36 may not be achieved during placement of workpiece 134 on surface 32, brush 158 also permits slight movement of workpiece 134 in its plane to achieve registration as pins 42 are moved to their raised position.

The moving means of the invention further comprises means for moving the tool from the mating station to the molding station. After locating pins 42 are moved to the raised position restraining workpiece 134 on molding surface 32, gripper mechanism 132 is removed from the workpiece, and brush 158 is moved away from mating station 62, tool 30 with workpiece 134 restrained thereon is ready for the molding operation. In the preferred embodiment, movement from mating station 62 to molding station 64 is effected by first drive mechanism 160 depicted in FIGS. 2 and 13. First drive mechanism 160 includes first platform 113 carrying first clamp 111 and elongated first hydraulic cylinder 162 connected to first platform 113 and disposed selectively to move the platform with tool 30 releasably fixed thereto by clamp 111 along guide tracks 60 to molding station 64. First platform 113 includes means such as channels for slidable cooperation with guide tracks 60. Under computer control, tool 30 with workpiece 134 is translated along tracks 60 to molding station 64 at which first clamp 111 releases tool 30 permitting first platform 113 and first clamp 111 to be returned to the predetermined position at mating station 62. Tool 30 with workpiece 134 restrained thereon by locating pins 42 remains at molding station 64.

In accordance with the invention, the apparatus comprises means at the molding station for forming the workpiece to the shape of the molding surface. As embodied herein and depicted in FIGS. 2, 13 and 15, the forming means comprises a ram press 170 including a cavity containing forming media 171 such as a bladder or trapped rubber. The cavity in press 170 is generally coextensive with molding station 64. When press 170 is moved under computer control into contact with molding station 64, media 171 forms workpiece 134 to the shape of molding surface 32. This forming operation is performed while locating pins 42 are in the raised position restraining workpiece 134 in the desired position on the molding surface. Because press 170 overlaps molding station 64, guide tracks 60 include resiliently mounted sections 172, 173 on opposite sides of station 64; stations 172, 173 permit full travel of press 170 during the forming operation without causing damage to guide tracks 60.

Figure 9:
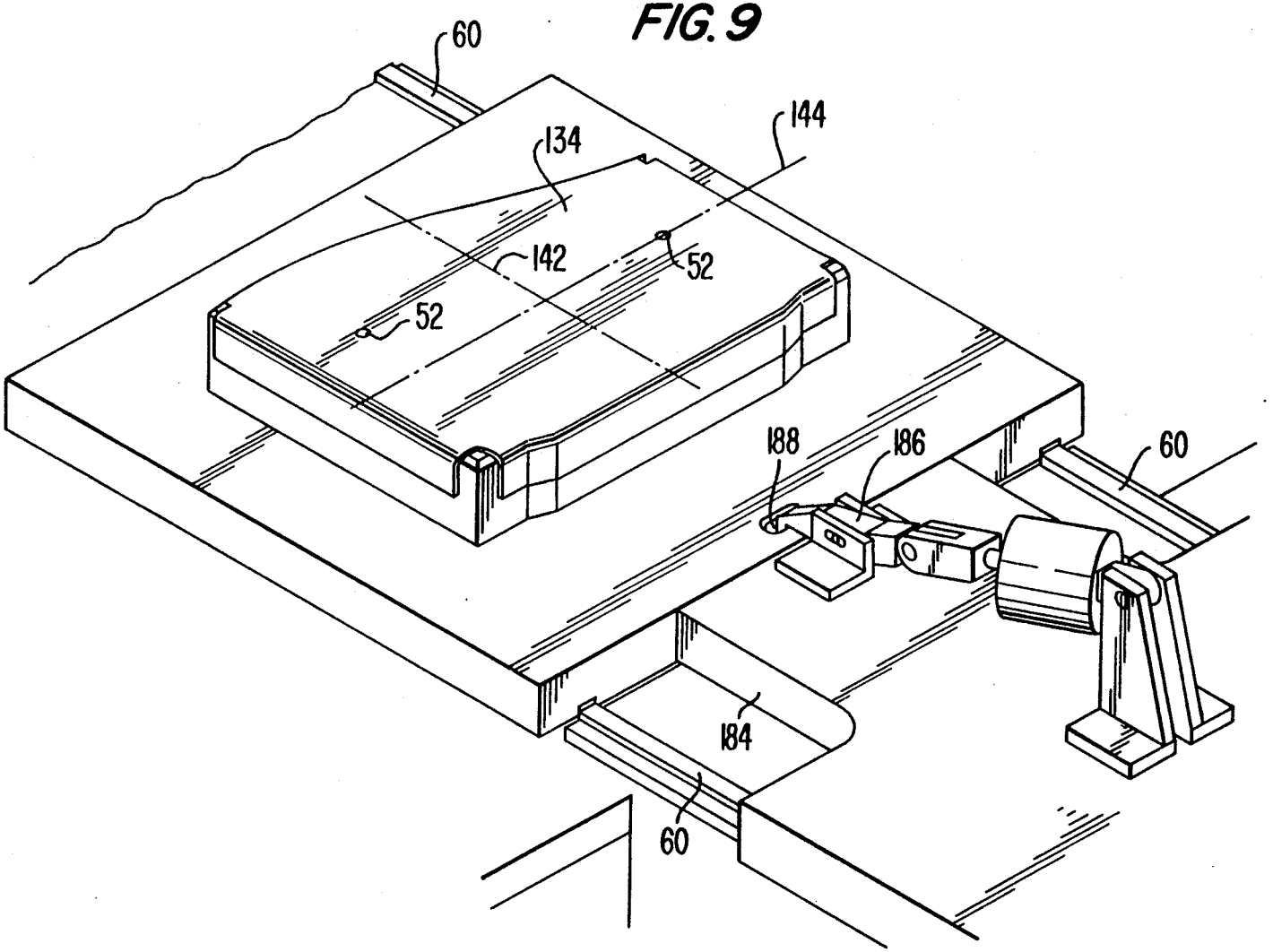
FIG. 9 is a perspective view of a forming tool with a shaped workpiece thereon disposed at the removal station of the invention.

After workpiece 134 is molded to molding surface 32 as depicted in FIG. 9, workpiece 134 must be removed from the molding surface. While this may be performed manually, in the preferred embodiment it is performed at removal station 66. To transport tool 30 with molded workpiece 134 thereon to the removal station, the moving means of the invention includes second drive mechanism 180 as depicted in FIGS. 2 and 14. Second drive mechanism 180 is structurally and operably identical to first drive mechanism 160 although the mirror image thereof. Elongated second hydraulic cylinder 182, under computer control, moves second platform 184 carrying second clamp 186 along tracks 60 to molding station 64 to selectively engage tool 30 in slot 188 proximate the other edge of tool base 31. Cylinder 182 is disposed to pull tool 30 with molded workpiece 134 thereon along tracks 60 to a predetermined position at removal station 66.

In accordance with the invention, the apparatus further comprises means at the removal station for removing the shaped workpiece from the tool. In the preferred embodiment the removing means comprises means for retracting the locating pins from the holes in the workpiece, means for fixing the tool in a predetermined position at the removal station, and means for engaging the workpiece through the holes therein and for carrying the workpiece from the tool to a receiving location.

Figure 10:
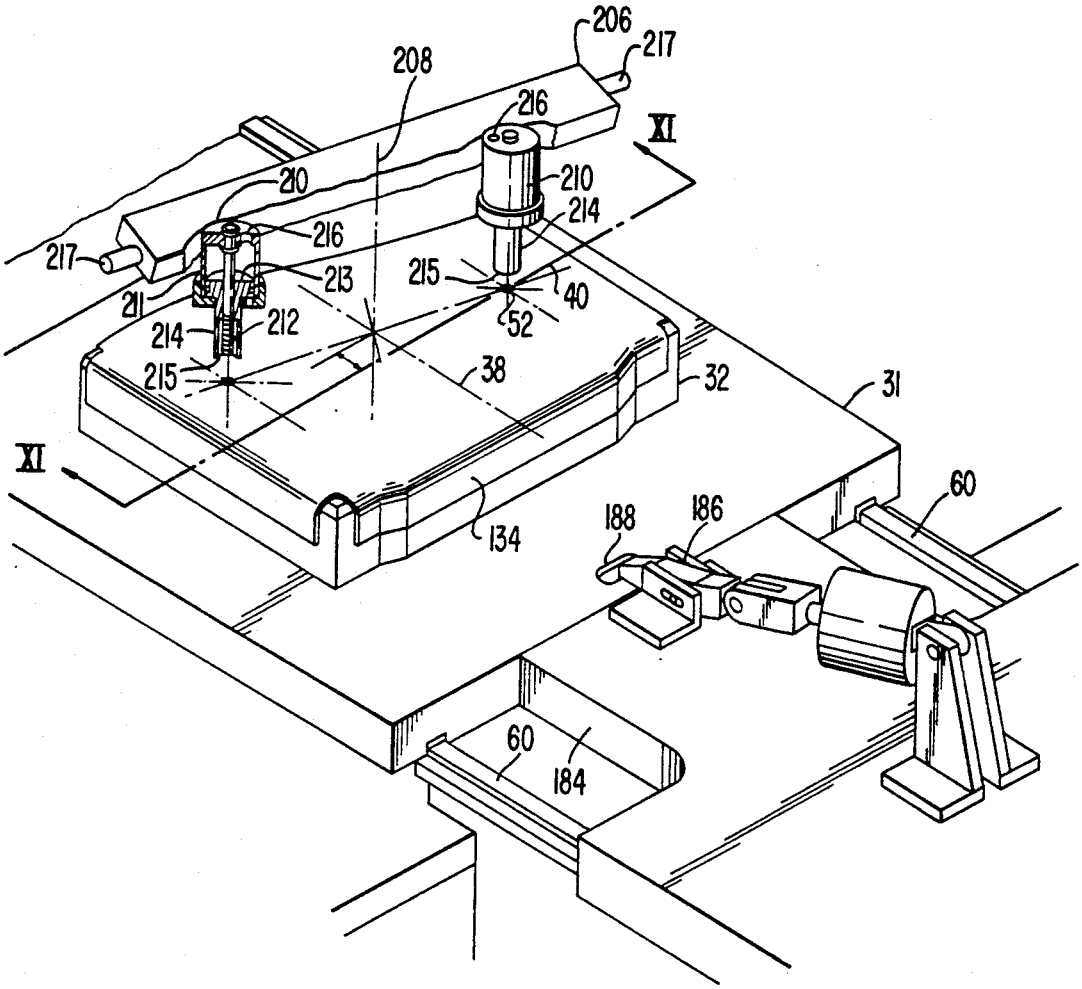
FIG. 10 is a partially cut-away perspective view depicting the mechanism for removing the formed workpiece from the forming tool.
Figure 11:
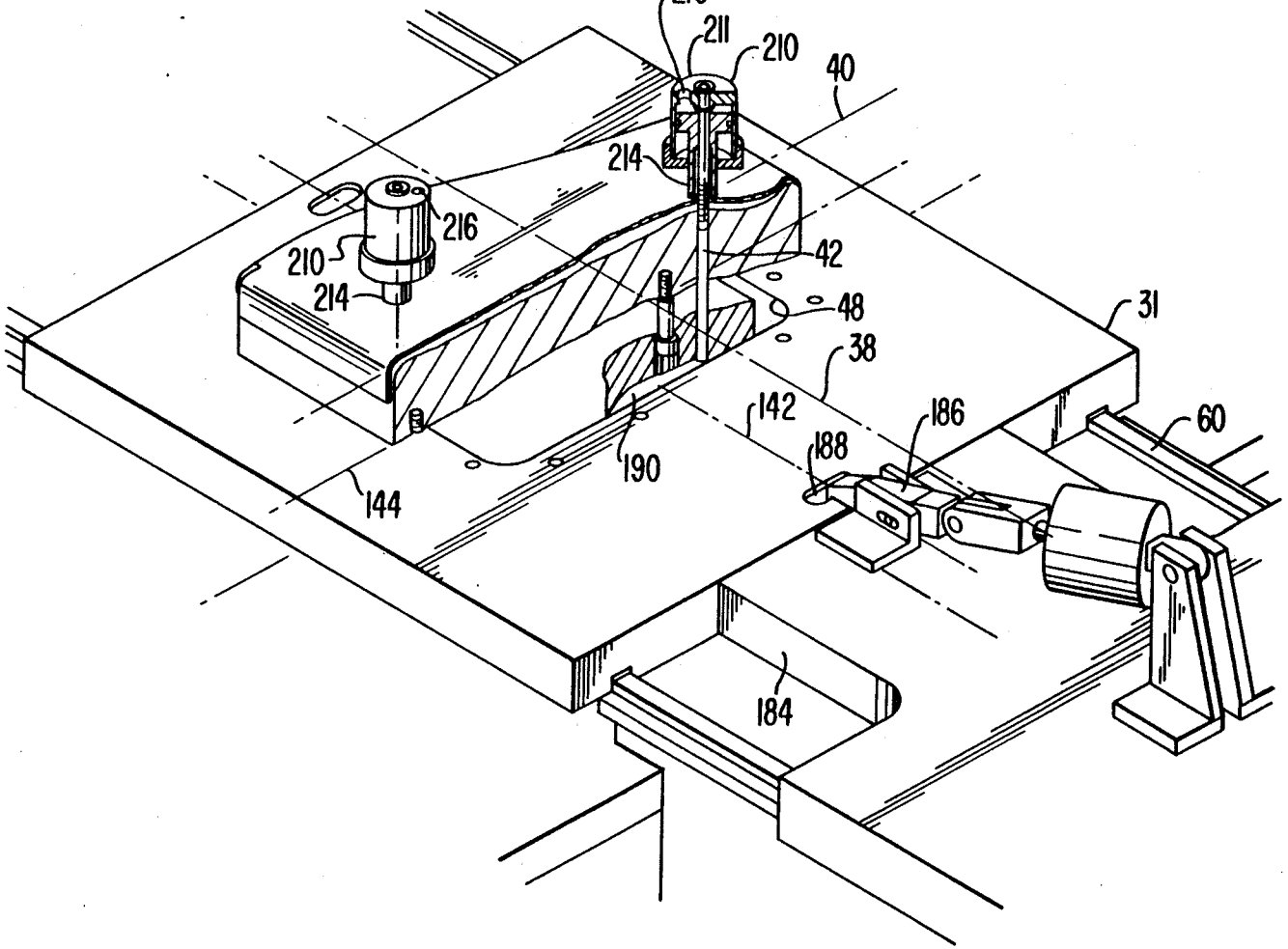
FIG. 11 is a cross-sectional view of the forming tool and removal mechanism taken along lines XI—XI of FIG. 10.
Figure 12:
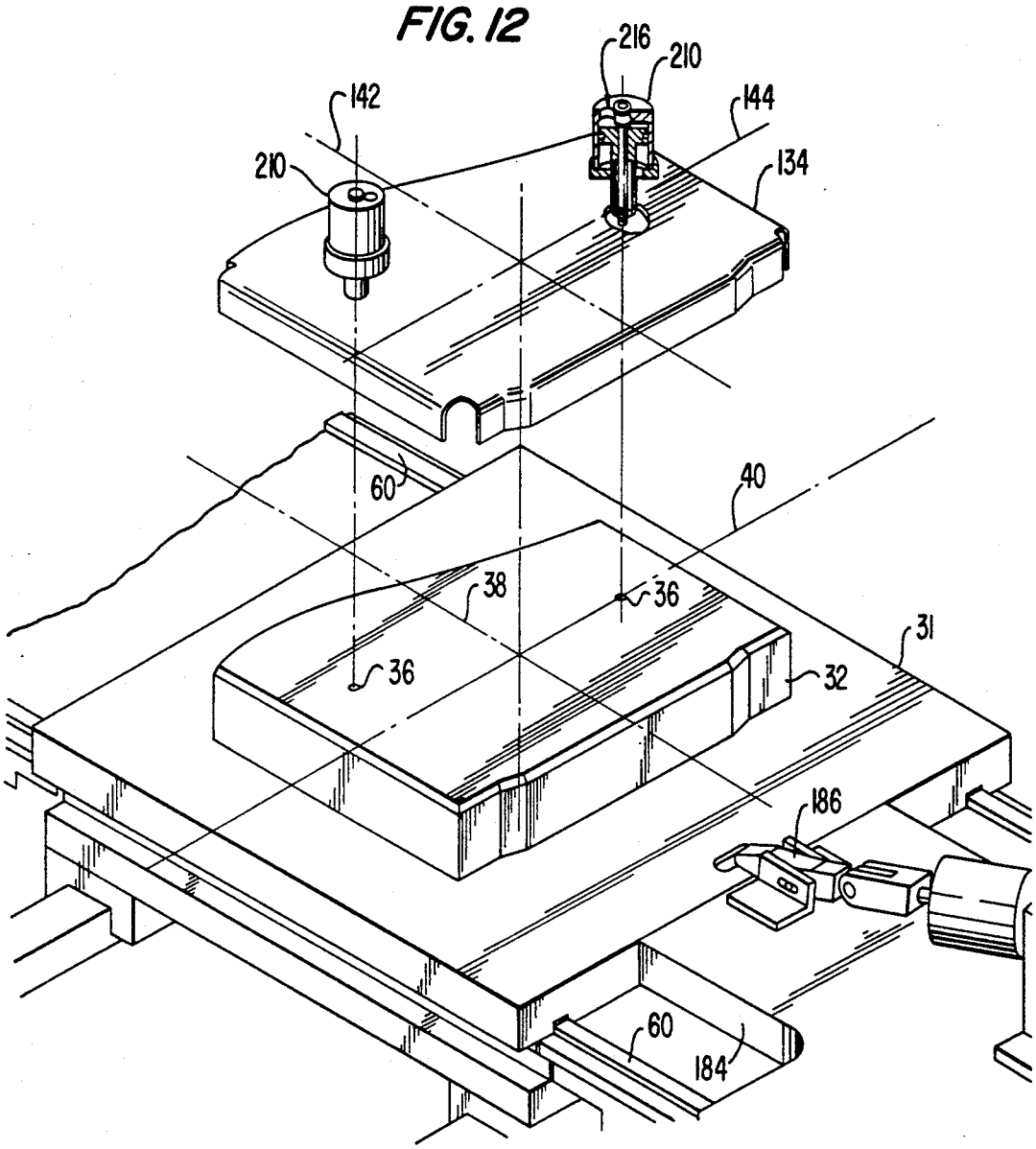
FIG. 12 is a perspective view of the forming tool at the removal station depicting removal of the workpiece

In the embodiment depicted in FIGS. 10–12, an electromagnet 90 is located at removal station 66 for alignment with recess 48 in the other surface of tool base 31 for selectively magnetically pulling cross bar 46 and attached locating pins 42 to the lowered position. Removal station 66 includes a recess (not depicted) between guide tracks 60 to permit movement of cross bar 46 to the lowered position.

As discussed with respect to first clamp 111, second clamp 186 of second drive mechanism 180 fixes tool 30 at removal station 66 in a predetermined position in abutting relation with second platform 184. Thus, at removal station 66, orthogonal reference Y axis 40 computer-defined on tool 30 is in a predetermined position. Orthogonal reference X axis 38 on tool 30 is in a predetermined position due to engagement of guide tracks 60 with channels 54 in the other surface of tool base 31.

The means for engaging and carrying the workpiece to a receiving location comprises part removal mechanism 200 as best seen in FIG. 14. Mechanism 200 includes frame 201 supporting way 202 for computer-controlled selective movement on an axis perpendicular to the plane of guide tracks 60. Way 202 supports carriage 203 for computer-controlled selective movement on an axis parallel to the plane of guide tracks 60. Carriage 203 includes cantilever beam 204 fixed thereto and supporting at the distal end thereof removal device 205. Removal device 205 includes cross beam 206 supported for selective rotation by motor 207 about a Z axis 208 (FIG. 10) perpendicular to and aligned with orthogonal X axis 38 of a tool 30 fixed in position at removal station 66.

Cross beam 206 includes cylindrical carriages 210 in fixed predetermined spaced relation thereon. Each cylindrical carriage 210 includes rod 211 fixed at one end to the cylinder 210 and having elongated brush 212 at the other end and a piston 213 coaxially disposed around rod 211 for movement between extended and retracted positions in cylinder 210. Fixed to each piston 213 is tube 214 extending to a distal face 215 for coaxially surrounding brush 212 in the extended position and exposing brush 212 in the retracted position. Each cylinder 210 includes bore 216 providing fluid communication with a respective fluid motor 217 for selectively driving piston 213 to the extended position. Fluid motors 217 preferably provide air pressure to respective cylinders 210.

In operation, the computer determines the location of holes 146 in workpiece 134 at removal station 66 relative to the X and Y axes 142, 144 defined on the workpiece. The hole positions relative to axes 142, 144, the known position of the axes at the removal station, and the known spacing of cylinders 210 permits the computer to determine the proper angle of rotation of cross beam 206 about Z axis 208 and the required relationship of Z axis 208 to Y axis 144 to coaxially align rods 211 with holes 146 in the formed workpiece 134 on molding surface 32 of tool 30 at removal station 66. The computer then directs air into cylinders 210 driving them to the extended position and lowers removal device 205 and cross beam 206 to place distal faces 215 into contact with workpiece 134. After locating pins 42 have been retracted to the lowered position, simultaneous release of air from cylinders 210 and further lowering of removal device 205 toward workpiece 134 forces brushes 212 into respective holes 146, brushes 212 engaging the workpiece. Removal device 205 is subsequently raised to remove workpiece 134 from molding surface 32 as depicted in FIGS. 12, 14 and 15. Carriage 203 is then translated to a receiving location. Over the receiving location air is forced by motors 217 into cylinders 210 moving pistons 213 to the extended position causing faces 215 to push workpiece 134 off of brushes 212.

Preferably, the section of guide tracks 60 defining removal station 66 is supported on carriage 220 (FIG. 15) for selective movement between removal station 66 and the one end of receiving station 80. Such movement is effected by computer controlled motor 221 and screw 222. Once tool 30 on removal station 66 is aligned with receiving station 80, push lever 86 is pivoted to the lowered position and translated on track 89 to move tool 30 along tracks 82 onto receiving station 80. Tool 30 is then identified by optical reader 84 and the computer determines whether it needs to be returned to feeding station 90 by push lever 86 or to storage station 70 by transporter 100.

It will be apparent to those skilled in the art that various modifications and variations could be made in the apparatus of the invention without departing from the scope or spirit of the invention.

What is claimed is:

1. An apparatus under control of a computer for forming into a three-dimensional shape a generally planar workpiece having a pair of spaced holes therein at predetermined positions, the apparatus comprising:

a forming tool including a molding surface having a pair of spaced bores therein at predetermined positions and a locating pin disposed in each bore for selective axial movement therein;

means for selectively moving the tool through an operating circuit including sequential mating, molding and removal stations;

means at the mating station for disposing the workpiece on the molding surface of the tool with respective hole and bore positions in registration;

means at the mating station for selectively projecting one end of each locating pin into a respective hole to restrain the workpiece on the molding surface, the projecting means including a brush selectably movable into contact with the workpiece on the molding surface for resisting movement of the workpiece away from the molding surface during movement of the one ends of the locating pins into the respective holes;

means at the molding station for forming the workpiece to the shape of the molding surface; and means at the removal station for removing the shaped workpiece from the tool.

2. The apparatus of claim 1 wherein the tool also includes a base supporting the molding surface on one side thereof and wherein the moving means comprises parallel guide tracks disposed for cooperation with parallel channels in the other side of the tool base, the guide tracks slidably supporting the tool in a predetermined orientation during movement through the circuit and during operations at each station.

3. The apparatus of claim 2 also including a plurality of tools each including a molding surface supported on one side of a base, a storage station for containing the plurality of tools in known locations, a receiving station for assembling tools in a predetermined order, a feeding station for conveying selected tools to the mating station, means for transporting selected tools between the storage station and the receiving station, means for transferring a tool from the removal station to the receiving station, means at the receiving station for identifying each tool disposed thereon, and means for delivering selected tools from the receiving station to the feeding station.

4. The apparatus of claim 3 wherein the feeding station comprises a plurality of saddles disposed for selective movement between the mating station and the receiving station, each saddle including guide tracks for slidably receiving one tool from the receiving station in predetermined orientation and for respectively aligning with the guide tracks of the moving means to place the one tool at the mating station.

5. The apparatus of claim 1 wherein the disposing means comprises means for selectively fixing the tool in a predetermined position at the mating station and means for retrieving a predetermined workpiece from a remote location and for placing the predetermined workpiece on the molding surface with respective holes and bores in axial registration.

6. The apparatus of claim 1 wherein the removing means comprises means for retracting the locating pins from the respective holes in the workpiece, means for fixing the tool in a predetermined position at the removal station, and means for engaging the workpiece through the holes therein and for carrying the workpiece from the tool to a receiving location.

7. A method of forming a generally planar workpiece to the shape of a molding surface on a forming tool, the method comprising the steps of:

drilling a pair of spaced holes in the workpiece at predetermined positions;

disposing the workpiece on the molding surface at a predetermined position with the holes in registration with a pair of spaced bores in the molding surface;

projecting one end of a locating pin disposed in each bore in the molding surface into a respective hole in the workpiece to restrain the workpiece in position on the molding surface;

molding the workpiece to the shape of the molding surface with one end of each locating pin in a respective hole;

retracting the locating pins from the holes in the workpiece;

engaging the workpiece through the holes therein; and removing the workpiece from the molding surface.

8. An apparatus under control of a computer for forming into a three-dimensional shape a generally planar workpiece having a pair of spaced holes therein at predetermined positions, the apparatus comprising:

a forming tool including a molding surface having a pair of spaced bores therein at predetermined positions and a locating pin disposed in each bore for selective axial movement therein;

means for selectively moving the tool through an operating circuit including sequential mating, molding and removal stations;

means at the mating station for disposing the workpiece on the molding surface of the tool with respective hole and bore positions in registration;

means at the mating station for selectively projecting one end of each locating pin into a respective hole to restrain the workpiece on the molding surface;

means at the molding station for forming the workpiece to the shape of the molding surface; and means at the removal station for removing the shaped workpiece from the tool, the removing means comprising a pair of elongated brushes disposed for selective insertion into the holes in the workpiece to engage the workpiece and remove it from the tool.

9. The apparatus of claim 8 wherein the projecting means includes brush means selectively moveable into contact with the workpiece on the molding surface for resisting movement of the workpiece away from the mold surface during movement of the one ends of the locating pins into the respective holes.

* * * * *